US005207346A

United States Patent [19]

Tiveron

[11] Patent Number: 5,207,346

[45] Date of Patent: May 4, 1993

[54] EASY-OPENING CLOSURE FOR THE SHEET METAL LIDS OF CANS AND THE LIKE

[75] Inventor: Egidio Tiveron, Silea - Treviso, Italy

[73] Assignee: Quarker, Chiari & Forti S.p.A., Parma, Italy

[21] Appl. No.: 605,980

[22] Filed: Oct. 23, 1990

Related U.S. Application Data

[63] Continuation of Ser. No. 410,485, Sep. 21, 1989, Pat. No. 5,048,713.

[51] Int. Cl.[5] ..... B65D 17/42

[52] U.S. Cl. ..... 220/277; 220/276

[58] Field of Search ..... 220/266, 276, 277

[56] References Cited

U.S. PATENT DOCUMENTS 2,004,946 6/1935 Hothersall ..... 220/276

2,601,937 7/1952 Ottesen ..... 220/276

3,303,957 2/1967 Walter ..... 220/266

*Primary Examiner*—Allan N. Shoap

*Assistant Examiner*—Nova Stucker

*Attorney, Agent, or Firm*—Notaro & Michalos

[57] ABSTRACT

A closure for lids made of sheet metal and secured as by a folded seam to the container body of cans and the like comprises, formed on the lid, a circular line of weakening and a circular groove adapted for engagement by a teaspoon or the like, to pry open the can, the groove having a U-shaped cross-sectional configuration and the line of weakening being a substantially V-shaped nick formed in the groove bottom close to the inboard wall thereof.

This closure affords easy-opening features for the can using a teaspoon for a lever, while making the can virtually break-proof against undesired opening due to inci7 dental shocks in handling and in transit.

9 Claims, 1 Drawing Sheet

EASY-OPENING CLOSURE FOR THE SHEET METAL LIDS OF CANS AND THE LIKE

This application is a continuation of application Ser. No. 07/410,485, filed Sep. 21, 1989 U.S. Pat. No. 5,048,713.

FIELD AND BACKGROUND OF THE INVENTION

This invention relates to a closure for a lid or end cover made of thin sheet metal and secured as by a seam to a container body for cans and the like, being of a type which comprises, formed on the lid, a circular line of weakening and a circular groove intended for engagement by a teaspoon or the like in order to pry the can open.

Such cans would have a simple construction compared to cans equipped with tear-open rings, for example, and should be found easy to open.

Until today, however, there have been no indications of their manufacture having ever been undertaken. In fact, such cans are to cope with two conflicting requirements: that they should be easy to open at the time of their consumption, and that they cannot be opened unintentionally when subjected to incidental shocks during their processing, such as on the occasion of their sterilization, and in transit.

Indeed, a closure designed to withstand incidental shocks without being open undesirably, would be also difficult to open using a teaspoon or such like utensil.

SUMMARY OF THE INVENTION

The problem that underlies this invention is to provide a closure of the type specified above, which has such structural and functional features as to be easily opened by the consumer, while being immune from incidental opening under shock.

This problem is solved by a closure as indicated being characterized in that the groove has a U-shaped cross-sectional configuration with an inboard wall, a bottom, and an outboard wall located next to the seam, and that the line of weakening is provided on the bottom of the groove.

BRIEF DESCRIPTION OF THE DRAWINGS

Further features and the advantages of the closure according to this invention will become more clearly apparent from the following detailed description of a preferred embodiment thereof, given by way of illustration and not of limitation with reference to the accompanying drawing, where.

DESCRIPTION OF THE PREFERRED EMBODIMENTS

Figure 1:
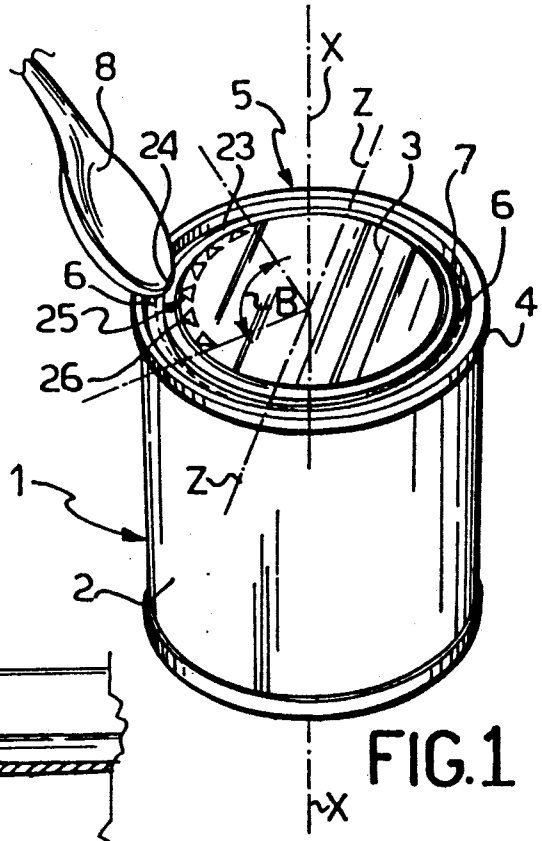
FIG. 1 is a perspective view of a can incorporating a closure according to the invention.
Figure 2:
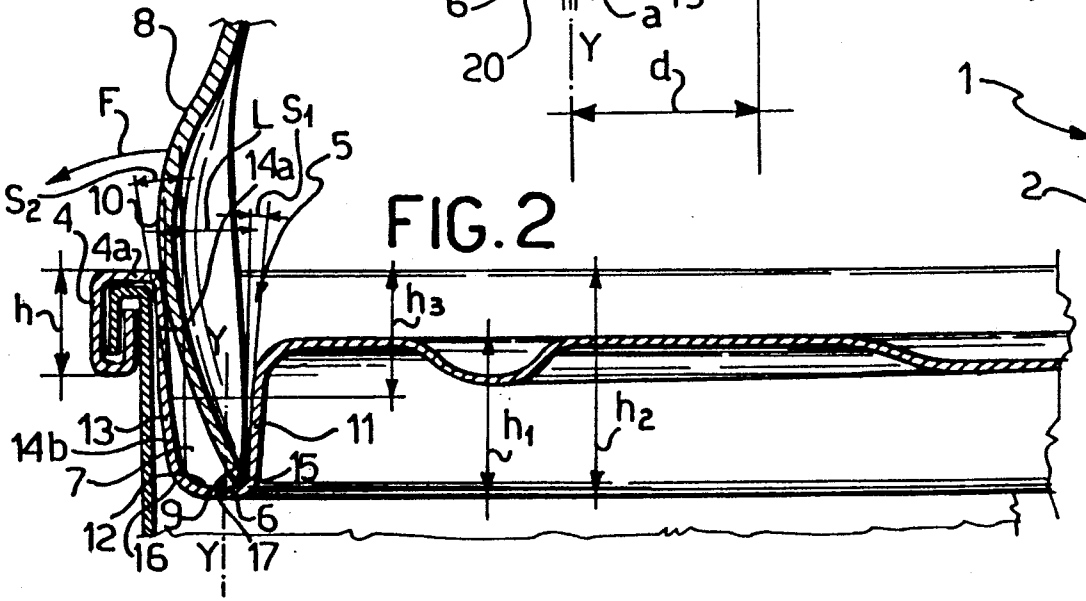
FIG. 2 is an enlarged scale, cross-sectional view of the closure shown in FIG. 1.
Figure 3:
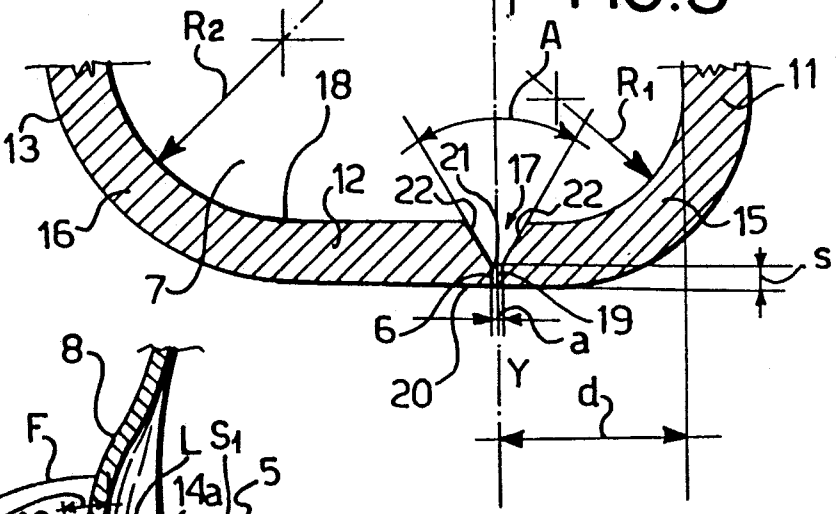
FIG. 3 is a cross-sectional view, to a further enlarged scale, of a detail of the closure shown in FIG. 1.

With reference to the accompanying drawing views, generally indicated at 1 is a can which comprises a cylindrical container body 2, having a diameter of 73 mm and an axis X—X, and a lid or end cover 3, both formed from thin sheet steel having a thickness of 0.18 mm. The lid 3 is secured on the container body 2 by means of a circular folded seam 4 which stands to a height h of about 2.5 mm from a top edge 4a thereof.

Sheet aluminum of a convenient thickness may be used instead of sheet steel, as is conventional practice for a skilled person in the art.

The can 1 is provided, at the lid 3, with a closure 5 which comprises a circular line 6 of weakening having around the axis X—X, and a groove 7, also circular around the axis X—X. The groove 7 is intended for engagement by a teaspoon 8 having a tip 9 and a back face 10, the teaspoon being applied so as to have its tip 9 engaged in the groove 7 and its back face 10 toward the seam 4.

The groove 7 has a substantially U-shaped cross-sectional configuration with an annular inboard wall 11, a flat bottom 12, and an annular outboard wall 13.

The inboard wall 11 is set at a short rake angle S1 to be selected from the 0° to 4° range, and has a height h1 within the range of 1.8 to 3.2 mm.

The outboard wall 13 of the groove has a height h2, measured from the seam edge 4a to the flat bottom 12, which should be selected in the 4.10 to 5.25 mm range. Best results have been obtained with the height h2 equal to 5.0 mm.

The outboard wall 13 of the groove has a section 14a located on the deam edge 4a side and having a predetermined height h3 in the 1.5 to 2.1 mm range. It should be noted that the section 14a lies parallel to the axis X—X or has, in other words, a truly cylindrical shape. Said section 14a forms a shoulder against which the back face 10 of the teaspoon 8 can find enhanced bearing.

The outboard wall 13 has a remaining section 14b, adjacent the section 14a and located on the side of the bottom 12, which is set at a rake angle S2 in the 6° to 9° range.

It should be noted that the groove 7 has a width L, measured between the verticals through points on the outboard and inboard walls which locate at the edge 4a and the bottom 12, respectively, said width dimension lying within the range of 1.70 to 2.30 mm. Best results have been obtained using a width L of 1.95 mm.

It should be further noted that, formed between the inboard wall 11 and the bottom 12 of the groove 7 is a fillet 15 of circular arc shape having a predetermined short radius R1. Advantageously, the radius R1 is within the range of 0.3 to 0.4 mm.

Note should also be taken of that, formed between the outboard wall 13 and the bottom 12, is a fillet 16 of circular arc shape having a predetermined short radius R2. Advantageously, the radius R2 is selected to lie within the range 0.5 to 0.7 mm.

The line of weakening 6 is provided on the bottom 12 of the groove, and its diameter should be selected to have the line 6 in the vicinity of the inboard wall 11 that is, in other words, located at a predetermined short distance d from the inboard wall 11. Advantageously, this distance d is in the 0.35 to 0.55 mm range, with 0.40 mm being a preferred value.

It should be noted that the line 6 of weakening is embodied by a nick 17 having a substantially V-shaped configuration in cross-section and an axis Y—Y, which is formed in the sheet metal of the lid 3 from an outer face 18 thereof at such a depth as to leave a bridging portion 19, having a predetermined thickness s, on the side of its inner face 20.

More specifically, the cross-sectional shape of the nick 17 is an isosceles trapezoid having a minor base 21 and two opposed sides, both indicated at 22, which flare out at a predetermined short angle A therebetween. The angle A lies preferably in the 45° to 65° range.

As for the minor base 21, this would be of short width a, to be selected from the range of 0.007 to 0.020 mm.

The thickness s of the bridge portion 19 left over varies between 0.060 mm and 0.075 mm where the sheet metal is steel, and between 0.100 mm and 0.130 mm where the sheet metal is aluminum.

It matters to observe that the sheet metal from which the lid is formed has a direction of rolling, indicated by the axis Z—Z, which lies tangent to an arc 23 of the circumference of the groove 7 corresponding to an angular breadth B of about 45°, with applied, at a midpoint 24 thereof along said arc 23, such as by stamping, suitable markings 25, e.g. a string of arrowheads 26, to draw the consumer's attention on the easy-to-open region of the arc 23.

If desired, where the sheet metal is steel, the nick 17 would be made deeper along at least two arcs of the circumference, so as to leave a bridging poriton along said arcs which has a smaller thickness than the bridging portion along the remainder of the circumference. The reduction in the thickness of the bridging portion along said arcs would be of about 0.005 mm.

To open the can 1, the teaspoon 8 is first introduced into the groove 7, preferably at the midpoint 24 of the arc 23, such that the tip 9 of the teaspoon locates at the fillet 15 and its back face 10 contacts the shoulder-forming section 14*a*. By levering on the teaspoon as indicated by the arrow F, a substantially horizontally directed force can be applied to the exact center of the fillet 15 which, by virtue of the reduced length of the radius R1, will act powerfully on the nick 17 in its immediate vicinity thanks to the reduced value of the distance d. This markedly local force will readily overcome the resistance from the bridging portion 19 and tear it open. Once the tearing has been so initiated, it can be easily extended all around the circumference to cause that portion of the lid which lies inboard of the nick 17 to come off altogether, and hence, the can to be opened completely.

In levering with the teaspoon, that portion of the lid which lies outboard of the nick, will behave in a sufficiently rigid manner not to undergo excessive distortion and develop excessive spring back during the operation, on account of the short length of the radius R2.

Unable to overcome the resistance from the bridging portion would be instead any shock to which the can may be subjected incidentally, because it would not be intensified on the nick with the required localized force.

A major advantage of the closure according to this invention is that it provides for easy opening of a can with a teaspoon or the like, while making the can immune from undesired opening due to incidental shocks.

Owing to the peculiar design of the closure, and specifically to the goove width, height of its outboard wall, cylindrical section of that same wall, and the angle of the inboard wall and the fillet radii, a teaspoon is enabled to perform as an effective lever, unlikely to loose its grip, and to put to the utmost use the effort exerted by the consumer.

A further advantage of the inventive closure is that it has shown enhanced safety features, in view of that it is virtually impossible to hurt or cut oneself on the inboard portion of the lid, once removed, because its free edge would lie at a very short distance from the inboard wall 11 acting as an effective protection.

In addition, the closure according to the invention lends itself to large volume manufacturing techniques at a relatively small cost, which is no negligible advantage with an article which is intended for disposal after use.

A further reduction in the cost of the closure according to the invention can be achieved on account of the finite thickness of the sheet metal from which the lid is formed being smaller than that required by closures of the tear-open ring type.

Furthermore, the closure of this invention makes use for its objective, i.e. the desired easy-opening features of the can, of the uneven strength of the sheet metal due to the latter opposing a smaller resistance in a perpendicular direction to the rolling direction.

Understandbly, the closure described in the foregoing may be altered and modified in many ways by a skilled one in the art in order to meet specific contingent demands, without departing from the true scope of the invention as set forth in the appended claims.

I claim:

1. A sheet metal closure secured by a seam (4) to a container body for a can having an axis (x), the closure comprising: a lid (3) having a circular peripheral groove (7) therein extending around the axis, the groove having a substantially U-shaped cross-sectional configuration with an annular inboard wall (11), a flat bottom (12), and an annular outboard wall (13) located next to the seam, the groove containing a circular line of weakening (6) and intended for engagement by a teaspoon in order to pry the can open by breaking the line of weakening, said outboard wall (13) having a cylindrical section (14*a*) at said seam, said cylindrical section forming a shoulder providing enhanced bearing for the teaspoon, the line of weakening being provided on the bottom of the groove, the inboard wall of the groove being at a small finite rake angle (S1) to the axis, a first fillet formed between the inboard wall and the bottom of the groove, the first fillet having a first short fillet radius (R1) between the inboard wall and the bottom of the groove lying within the range of 0.3 to 0.4 mm, and the line of weakening being provided at a predetermined short distance (d) from the inboard wall of the groove, said short distance lying within the range of 0.35 to 0.55 mm, the line of weakening being embodied by a substantially V-shaped nick (17) formed in the sheet metal of the lid from an outboard face (18) thereof to leave a bridging portion (19) of predetermined thickness (s) on an inboard face (20) of the lid, the nick having a cross-sectional shape configured as an isosceles trapezoid having a minor base (a) of predetermined short length and opposed sides (22) flaring out at a predetermined short angle (A), the length of said minor base being 0.007 to 0.020 mm, and the thickness (s) of the bridging portion being 0.060 to 0.075 mm where the sheet metal is steel, and 0.100 to 0.130 mm where the sheet metal is aluminum, a second fillet having a second short radius (R2) formed between the outboard wall and the bottom of the groove, the second short radius between the outboard wall and the bottom of the groove being 0.5 to 0.7 mm, the outboard wall of the groove having a height (h2) measured from the flat bottom to the top of the seam, which is 4.10 to 5.25 mm, the groove having a width (L) measured between vertical lines through points on the outboard wall and inboard wall at the edge and the bottom, respectively, lying within the range of 1.70 to 2.30 mm.

2. A closure according to claim 1, characterized in that said cylindrical section has a height in the 1.5 to 2.1 mm range.

3. A closure according to claim 2, characterized in that the outboard wall has a remaining section set at a rake angle in the 6° to 9° range.

4. A closure according to claim 3, characterized in that the inboard wall has a height in the 1.8 to 3.2 mm range.

5. A closure according to claim 1, characterized in that said angle between the flaring sides is in the 45° to 65° range.

6. A closure according to claim 1, wherein the lid as a central platform surrounded by the peripheral groove and being substantially in a plane containing an upper edge of the inboard wall.

7. A closure according to claim 6 wherein said outboard wall has an upper edge which is in a second plane that is higher than the plane containing said upper edge of inboard wall.

8. A closure according to claim 7 where the outboard wall has a section which extends parallel to the axis and has a height (h3) along the outboard wall to said second plane which is equal to approximately 1.5 to 2.1 mm, said groove having a depth from the bottom of the groove to the second plane (h2) of approximately 4.10 to 5.25 mm, the inboard wall having a height to the first mentioned plane (h1) of approximately 1.8 to 3.2 mm.

9. A closure according to claim 6 wherein the outboard wall has an upper section spaced from the bottom of the groove which is substantially parallel to the axis, and a lower section which is adjacent the bottom of the groove which extends at a rake angle of about 6° to 9°.

* * * * *